US007114350B2

(12) United States Patent
Soldinger et al.

(10) Patent No.: US 7,114,350 B2
(45) Date of Patent: Oct. 3, 2006

(54) REFRIGERATOR WITH EVAPORATOR OF VARIABLE DIMENSIONS

(75) Inventors: Riccardo Soldinger, Milan (IT); Enrica Monticelli, Varese (IT); Roberta Bernasconi, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/849,732

(22) Filed: May 21, 2004

(65) Prior Publication Data

US 2004/0237579 A1 Dec. 2, 2004

(30) Foreign Application Priority Data

May 21, 2003 (IT) ..... MI2003A1021

(51) Int. Cl.
*F25B 39/02* (2006.01)

(52) U.S. Cl. ..... 62/515; 165/86

(58) Field of Classification Search ..... 62/515, 62/516, 517, 518, 519; 165/86, 96, 46
See application file for complete search history.

(56) References Cited

U.S. PATENT DOCUMENTS

| | | | | |
|---|---|---|---|---|
| 1,957,036 | A | 5/1934 | Baars et al. | |
| 4,061,184 | A * | 12/1977 | Radcliffe | 165/286 |
| 4,206,609 | A * | 6/1980 | Durenec | 62/6 |
| 4,538,583 | A * | 9/1985 | Earl | 123/557 |
| 4,693,302 | A | 9/1987 | Dodds | |
| 4,697,427 | A * | 10/1987 | Niggemann et al. | 62/119 |
| 4,747,928 | A * | 5/1988 | Takahashi et al. | 204/298.09 |
| 5,265,444 | A * | 11/1993 | Martin | 62/515 |
| 5,372,017 | A * | 12/1994 | Zorea et al. | 62/457.9 |
| 5,402,656 | A * | 4/1995 | Jaster et al. | 62/515 |
| 5,564,288 | A * | 10/1996 | Lewis | 62/372 |
| 5,634,351 | A * | 6/1997 | Larson et al. | 62/259.2 |
| 5,715,689 | A * | 2/1998 | Byczynski et al. | 62/81 |
| 5,832,738 | A * | 11/1998 | Shin | 62/276 |
| 5,896,753 | A * | 4/1999 | Kwak et al. | 62/441 |
| 5,906,108 | A * | 5/1999 | Kidwell | 62/209 |
| 5,974,824 | A * | 11/1999 | Galockin et al. | 62/394 |
| 6,101,821 | A * | 8/2000 | Cates | 62/139 |
| 6,701,718 | B1 * | 3/2004 | Pisciotta | 62/3.3 |
| 2003/0164245 | A1 * | 9/2003 | Areskoug | 174/110 R |

FOREIGN PATENT DOCUMENTS

| | | | |
|---|---|---|---|
| GB | 400 853 | | 11/1933 |
| JP | 60 105888 | | 6/1985 |
| JP | 61 003993 | | 1/1986 |
| JP | 61 184392 | | 8/1986 |
| JP | 02 267491 | | 11/1990 |
| JP | 2000-257961 | A * | 9/2000 |
| JP | 2002 235989 | | 8/2002 |
| KR | 2001105615 | A * | 11/2001 |
| KR | 2002012726 | A * | 2/2002 |
| TW | 425501 | A * | 3/2001 |
| WO | WO 93/10270 | A1 * | 5/1993 |

* cited by examiner

*Primary Examiner*—Mohammad M. Ali
(74) *Attorney, Agent, or Firm*—Robert O. Rice; Stephen Krefman; John F. Colligan

(57) ABSTRACT

A refrigerator with an evaporator and at least one preservation compartment, in which the evaporator is formed from extendable spiral-wound tube of engineering polymer.

16 Claims, 2 Drawing Sheets

REFRIGERATOR WITH EVAPORATOR OF VARIABLE DIMENSIONS

BACKGROUND OF THE INVENTION

1. Field of the Invention

The present invention relates to a refrigerator provided with an evaporator or evaporators.

2. Description of the Related Art

In traditional refrigerators the evaporator, however constructed, is defined, i.e. unmodifiable, size and location. It follows that possible cold deficiencies or excesses cannot be compensated during refrigerator use. In forced-air refrigerators these unbalances can be modified, but only partly, by operating the flaps or other members by which the direction and throughput of the forced air acting as the cold carrier are changed.

SUMMARY OF THE INVENTION

An object of the present invention is to provide a refrigerator having a evaporator which, when in use, is able to assume different locations and sizes based on the practical utilization requirements of the refrigerator.

These and further objects which will be more apparent from the ensuing detailed description are attained by a refrigerator with an evaporator in accordance with the technical teachings of the accompanying claims.

BRIEF DESCRIPTION OF THE DRAWINGS

The invention will be more apparent from the description of preferred embodiments thereof given hereinafter by way of non-limiting example with reference to the accompanying drawings, in which.

DETAILED DESCRIPTION

Prior to the ensuing detailed description, it should be noted that the essence of the invention lies in the use, as the evaporator of a preferably domestic refrigerator, of a reinforced or non-reinforced plastic tube which is spiral-wound (in the sense of being formed from for example helical turns) such as to be able to be elastically lengthened, i.e. in the manner of a spring. This enables the user to obtain a required (for example different) temperature distribution within the refrigerator.

Figure 1:
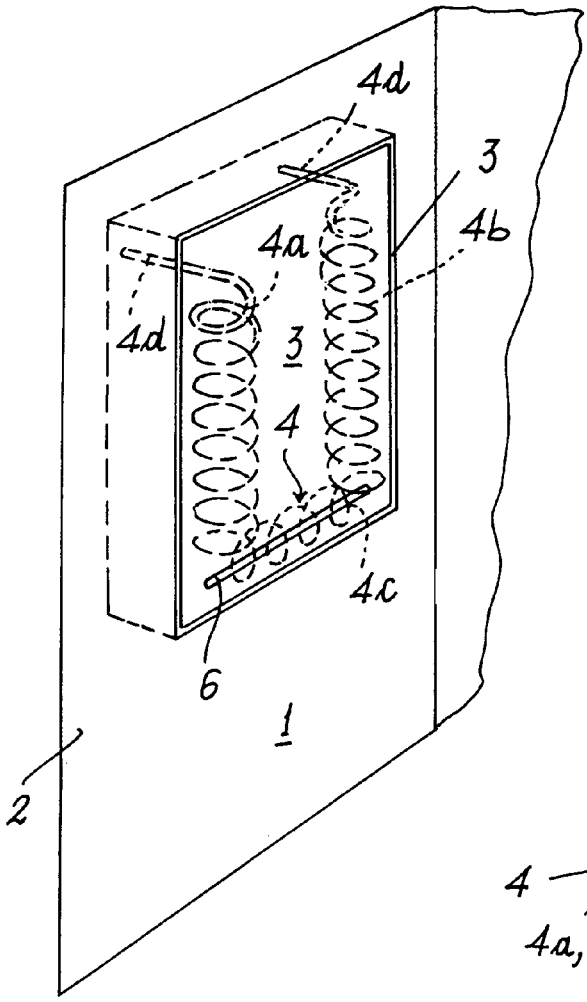
FIG. 1 is a schematic view of the preservation compartment of a refrigerator according to the invention incorporating an evaporator formed from a spiral-wound, i.e. substantially helically-extending, flexible tube.
Figure 2:
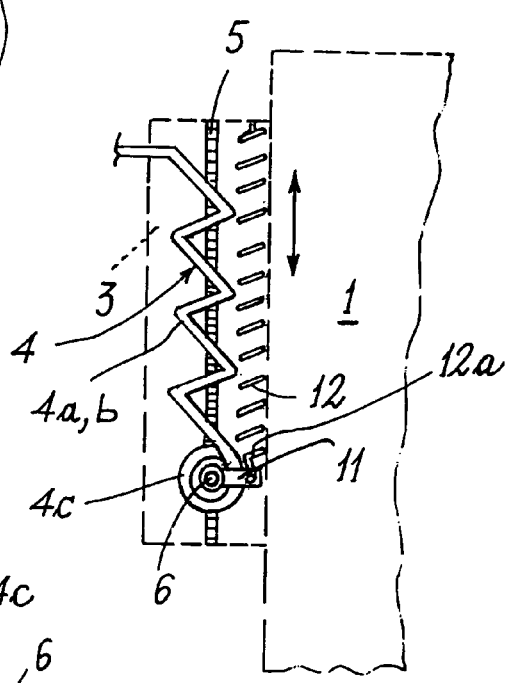
FIG. 2 is a more complete schematic side view of the evaporator region of the refrigerator of FIG. 1.
Figure 3:
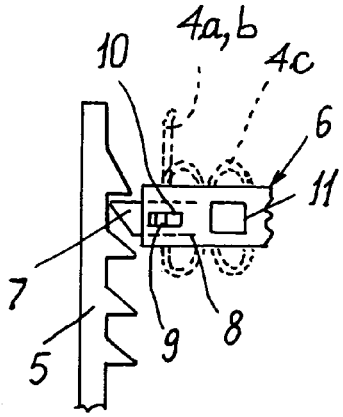
FIG. 3 shows schematically a possible solution for modifying the size of the evaporator of the preceding figures.

With regard to the drawings, and in particular FIGS. 1–3, the reference numeral 1 indicates the preservation compartment of a refrigerator. A chamber 3 is provided in the rear wall 2 of this compartment. Within this chamber there extends the extendable evaporator, indicated overall by 4, in the form of a spiral-wound tube presenting, in this example, two vertical parallel portions 4*a*, 4*b* and a lower horizontal portion 4*c* between these latter. The upper ends 4*d* of the two vertical portions 4*a*, 4*b* are connected to a conventional refrigeration circuit in known manner.

In this example, which is non-limiting, rack formations 5 are shaped on or applied to the two facing side walls of the chamber 3, to act as stops enabling the evaporator to be (removably) fixed thereto with the size desired by the user, to obtain the required but different temperature distribution within the refrigerator chamber 1.

More particularly, the horizontal portion 4*c* of the evaporator is traversed by a rod 6. At one end of this rod there is mounted a slidable (retracting) tooth 7 which cooperates with a sprung counteracting member 8. The tooth 7 is retracted by the user who for this purpose acts on a projection 9, rigid with the tooth 7 and projecting from an opening 10 in the rod 6. At its other end the rod is provided with a fixed tooth, not shown.

The lowest thin blade 12*a* of a series of parallel blades 12 forming a movable wall of Venetian blind type is connected to the rod 6 by arms 11, the various blades being connected together for example in the manner of a Venetian blind.

The highest blade is connected to the upper wall of the chamber 3.

By unhooking the rod 6 from one position on the rack and hooking it to another position, the size of the vertical portions 4*a*, 4*b* and the opening of the chamber 4 towards the compartment 1 can be modified to obtain a different temperature distribution within this latter.

Figure 4:
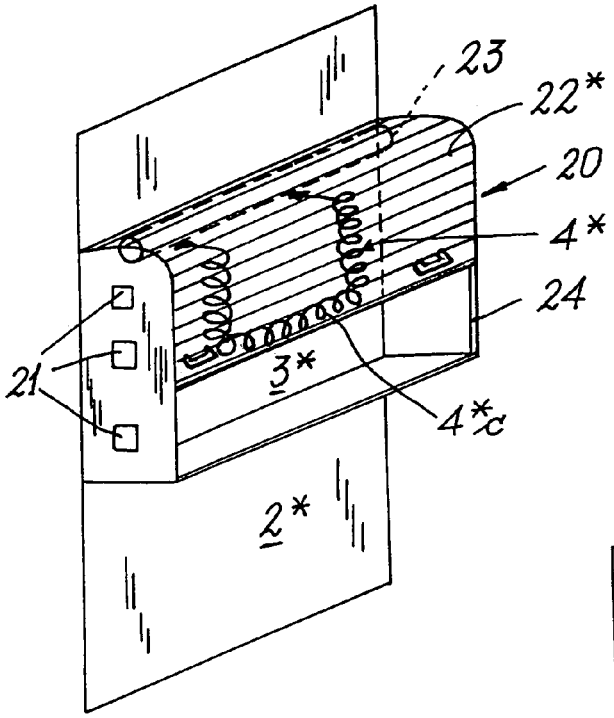
FIG. 4 shows schematically an extendable evaporator incorporated within a chamber closed by a shutter or roll shutter, and projecting into the refrigerator preservation compartment.

FIG. 4 shows a variant in which the chamber, here indicated by 3*, is provided in a part 20 projecting from the rear wall 2* of the refrigerator compartment and provided with lateral apertures 21. In this variant, the extendable evaporator is indicated by 4* and presents two lateral portions and a lower intermediate portion 4*c. This latter is connected to a roll shutter 22 windable about a roller 23 and guided along the sides in guide grooves 24 present in the side walls of the part 20.

Figure 5:
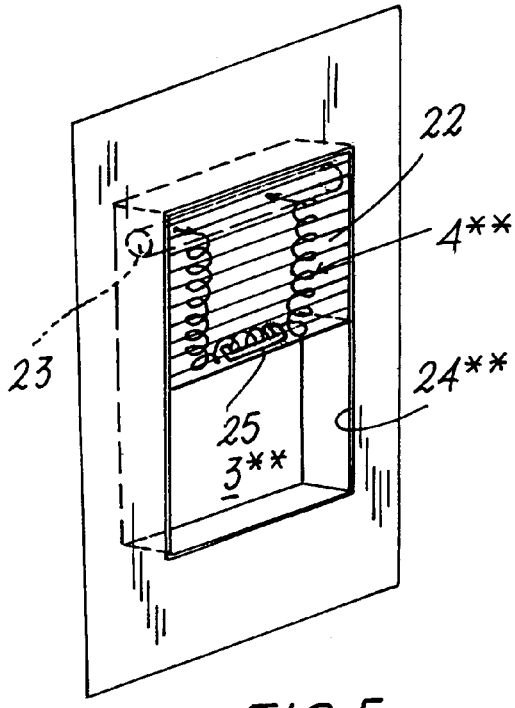
FIG. 5 shows schematically an extendable evaporator incorporated into a re-entering chamber of the refrigerator preservation compartment.

The variant of FIG. 5 can be considered very similar to the solution of FIGS. 1, 2, 3. The difference lies in the fact that the chamber (here indicated by 3) containing the extendable evaporator can be intercepted totally or partly by a shutter or roll shutter (here indicated by 22**) which when moved also moves the evaporator (here indicated by 4**). The roll shutter 4** is guided in lateral guides 24**, it winds onto (unwinds from) a roller 23** and is operated by a handle 25**.

Figure 6:
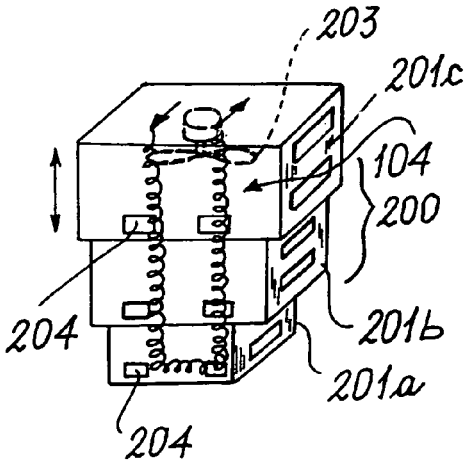
FIG. 6 shows schematically a telescopic chamber mounted in the refrigerator compartment and incorporating the extendable evaporator.

A further variant is shown in FIG. 6. In this variant the evaporator, here indicated by 104, is contained in the interior of a telescopic body 200 formed for example of three sections 201*a, b, c*. The lower portion of the evaporator is fixed to the lower section 201*a*; the ends of the two extendable sections are fixed to the upper section which represents the fixed section, i.e. that rigid for example with the upper wall of the refrigerator compartment.

A fan 203 can be housed in this section 201*c* to provide a flow of air which variously leaves from adjustable apertures 204 present in the three sections 201*a, b, c* and which are preferably of parallelepiped form.

The constituent plastic tube of the invention can be of nylon or its derivatives, or acetal resin, this list not however placing a limitation on the invention.

The evaporator can comprise several portions in parallel or in series or series/parallel; it can constitute an excludable auxiliary evaporator; the turns of the tube can be flattened or oval in form.

We claim:

1. A refrigerator comprising:

at least one preservation compartment;

a first evaporator comprising an extendable tube having a first portion wound around a support and a second portion unwound from the support, wherein the tube is extendable by unwinding the tube from the support to decrease the size of the first portion while increasing the size of the second portion.

2. The refrigerator according to claim 1, wherein the tube is formed with helical turns.

3. The refrigerator according to claim 1, wherein at least a portion of the first portion of the tube is fixed relative to the refrigerator.

4. The refrigerator according to claim 3, wherein the support is a rod that is movably mounted for relative movement with respect to the refrigerator.

5. The refrigerator according to claim 1, and further comprising a chamber separate from the at least one preservation compartment for enclosing the tube, and the chamber communicates with the preservation compartment via at least one aperture.

6. The refrigerator according to claim 5, and further comprising a manually adjustable interception means for varying the opening of the at least one aperture.

7. The refrigerator as claimed in claim 6, wherein the interception means is selected from a group consisting of a curtain, a Venetian blind, a shutter, or a roll shutter, the relative movement of which causes simultaneous variation in the size of the first and second portions of the tube.

8. The refrigerator as claimed in claim 5, wherein the chamber is telescopic and comprises a fan.

9. A refrigerator comprising:

at least one preservation compartment;

a chamber separate from the at least one preservation compartment and in communication with the at least one preservation compartment through an aperture; and a first evaporator located in the chamber and comprising an extendable spiral-wound tube portion having an extended portion and a non-extended portion, with the length of the extended portion defining an effective cooling length, wherein the effective cooling length can be varied by selectively winding or unwinding the non-extended portion around a support to vary the length of the extended portion to change the cooling capacity of the evaporator.

10. The refrigerator as claimed in claim 9, wherein a second conventional evaporator is provided.

11. The refrigerator as claimed in claim 9, wherein the first evaporator is excludable.

12. The refrigerator as claimed in claim 9, wherein a manually adjustable interception means is provided for varying the opening of the aperture.

13. The refrigerator as claimed in claim 12, wherein the interception means is selected from a group consisting of a curtain, Venetian blind, shutter, or roll shutter, the relative movement of which causes a simultaneous change in the effective cooling length.

14. The refrigerator as claimed in claim 9, wherein the first evaporator comprises at least two substantially parallel portions and an intermediate transverse portion.

15. The refrigerator as claimed in claim 9, wherein the chamber containing the first evaporator is telescopic and incorporates a fan.

16. The refrigerator as claimed in claim 9, wherein the size of the at least one aperture is variable.

* * * * *